US009926493B2

(12) United States Patent
Nicholas

(10) Patent No.: US 9,926,493 B2
(45) Date of Patent: Mar. 27, 2018

(54) PROCESS FOR THE REMOVAL OF THE HEAVY OIL FROM TAR SAND (EITHER OIL/HYDROCARBON WET OR WATER WET DEPOSITS) AND THE CLEANING UP OF THE EFFLUENT

(71) Applicant: Dolly Nicholas, Marabella (TT)

(72) Inventor: Dolly Nicholas, Marabella (TT)

( * ) Notice: Subject to any disclaimer, the term of this patent is extended or adjusted under 35 U.S.C. 154(b) by 0 days.

(21) Appl. No.: 15/136,233

(22) Filed: Apr. 22, 2016

(65) Prior Publication Data

US 2017/0306241 A1 Oct. 26, 2017

(51) Int. Cl.
*C10G 1/04* (2006.01)

(52) U.S. Cl.
CPC ..... *C10G 1/045* (2013.01)

(58) Field of Classification Search
CPC ..... C10G 15/00; C10G 33/00; C10G 33/02; C10G 33/06; C10G 2300/302
See application file for complete search history.

(56) References Cited

U.S. PATENT DOCUMENTS

| | | | |
|---|---|---|---|
| 3,993,555 A | 11/1976 | Park et al. | |
| 4,003,432 A | 1/1977 | Paull et al. | |
| 4,036,732 A | 7/1977 | Irani et al. | |
| 4,347,118 A | 8/1982 | Funk et al. | |
| 4,448,667 A | 5/1984 | Karnofsky | |
| 4,539,097 A | 9/1985 | Kelterborn et al. | |
| 4,572,777 A | 2/1986 | Peck | |
| 4,584,087 A | 4/1986 | Peck | |
| 4,673,484 A | 6/1987 | Babcock et al. | |
| 4,699,709 A | 10/1987 | Peck | |
| 4,722,782 A | 2/1988 | Graham et al. | |
| 4,818,373 A | 4/1989 | Bartholic et al. | |
| 5,143,598 A | 9/1992 | Graham et al. | |
| 5,728,202 A | 3/1998 | Nelson et al. | |
| 6,451,885 B1 | 9/2002 | Dresin et al. | |
| 6,883,607 B2 | 4/2005 | Nenniger et al. | |
| 2010/0101981 A1* | 4/2010 | Moffett | C04B 28/24 208/391 |
| 2015/0299580 A1* | 10/2015 | Moffett | B09B 3/0016 208/391 |

FOREIGN PATENT DOCUMENTS

| | | |
|---|---|---|
| TT | TT/A/2008/00122 | 5/2008 |
| WO | WO 2006/037045 A1 | 4/2006 |
| WO | WO 2006/044485 A2 | 4/2006 |

* cited by examiner

*Primary Examiner* — Randy Boyer
*Assistant Examiner* — Juan C Valencia
(74) *Attorney, Agent, or Firm* — Nixon & Vanderhye, PC

(57) ABSTRACT

A process for the removal of heavy oil/bitumen from oil/hydrocarbon wet and/or water wet tar sand. The tar sand is mixed with an inorganic liquid such as water or a treated effluent and an inorganic solid which is a silicate or metasilicate for a period of time sufficient for the inorganic liquid and the inorganic solid to interact and strip the heavy oil/bitumen from the tar sand. The process includes additional steps to produce clean heavy oil/bitumen and clear effluent.

16 Claims, 1 Drawing Sheet

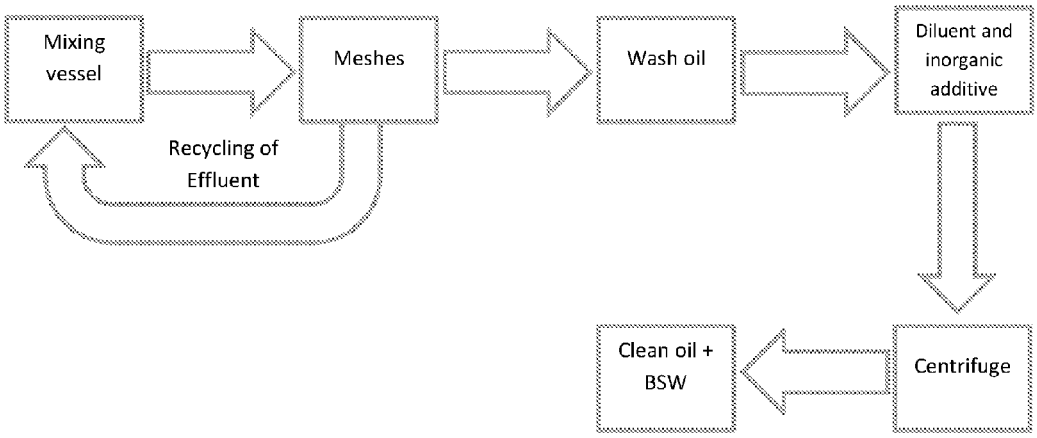
Mixing vessel
Meshes
Wash oil
Diluent and inorganic additive
Recycling of Effluent
Centrifuge
Clean oil + BSW

PROCESS FOR THE REMOVAL OF THE HEAVY OIL FROM TAR SAND (EITHER OIL/HYDROCARBON WET OR WATER WET DEPOSITS) AND THE CLEANING UP OF THE EFFLUENT

BACKGROUND OF INVENTION

1. Field of the Invention

This invention deals with the addition of an inorganic liquid e.g. water and an inorganic additive e.g. a silicate and/or a metasilicate, such that when both additives interact, they combine to remove the heavy oil/bitumen from either oil/hydrocarbon wet, or water wet, tar sand. Each type of tar sand could be weathered/deteriorated or not.

2. Description of Background Art

Extraction of the heavy oil from tar sands falls into two classes—open pit mining and in situ mining. With the open pit mining process, the tar sand is transported to an extraction plant, where a hot water process separates the bitumen (heavy oil) from the tar sands.

In situ methods are used on the tar sands deposits which are too deep to be mined, and include but are not limited to, stem injection, solvent injection, and firefloods. The latter involves the injection of oxygen with part of the resources being burnt so as to provide the necessary heat.

Of all the in situ methods, steam injection is the favoured method.

The environmental problems associated with all the methods which presently exist are very well documented and include the following:

1) The use of large amounts of fresh water
2) Holding ponds
3) Tailing ponds
4) Evolution of carbon dioxide
5) The use of a large amount of energy.

The present invention solves all the problems listed above.

It is particularly worth noting that this invention also solves issues not addressed by Trinidad and Tobago Patent # TT/A/2008/00122. More specifically the latter patent does not address the following (which are all addressed in the process described herein):

Cleaning up of the effluent and its reuse.

The actual yield of oil was never obtained in patent #TT/A/2008/00122—yield was calculated by virtue of ashing of the spent clay/sand.

Removal of heavy oil from oil wet/hydrocarbon wet tar sands. Patent #TT/A/2008/00122 is specifically for the water wet tar sand found in Trinidad & Tobago.

Patent #TT/A/2008/00122 does not address the issue of cost effectiveness.

Patent #TT/A/2008/00122 requires a mixing time of >24 hrs.

Patent #TT/A/2008/00122 does not improve the yield of the heavy oil without the use of demulsifiers

BRIEF SUMMARY OF INVENTION

Into the mechanical mixer is placed tar sand (oil or water wet), an inorganic liquid e.g. water or treated effluent, and an inorganic solid. This inorganic solid belongs to the class of silicates/metasilicates and is designed so as to interact with the inorganic liquid e.g. water so that the two combined strip the heavy oil/bitumen off the sand grains.

No demulsifiers are used in the process.

The mixture is passed through two meshes (cm size) which trap the oil to which is attached some clay and sand. The effluent is then recirculated into the mixing vessel and passed through the strainers. This process is repeated until the vessel is clear of sand and clay.

The heavy oil/bitumen once released from the tar sand contains clay/sand which is advantageous to the process. Hence a mixing time is utilised which allows optimal release of the bitumen/heavy oil and still allows the bitumen/heavy oil to have sufficient clay/sand incorporated so as to facilitate the straining process.

The residue in the meshes therefore consists of the oil (which is mostly clean but to which is attached some sand and clay), whilst the filtrate consists of muddy effluent and free sand.

The process yields:

Effluent-water which is a muddy 'solution' of clay with the denser sand settling at the bottom (Photo 2).

Oil which is mostly clean but to which is attached some sand and clay.

To remove further clay and sand (and sometimes small pebbles) the dirty oil is washed with water or treated effluent of a temperature not higher than 58° C. The oil is cleaner (Photo 3), but still not completely clean and the effluent is still muddy coloured.

All the effluent is pooled together (Photo 2).

To the oil is added a diluent and another inorganic solid chemical. The function of this second inorganic chemical e.g. a chloride or sulphate or nitrate, is two-fold:

1. to enter into the clay/sand/water part of the oil (which does not dissolve into the diluent), and strip all the solids/water from the oil, and
2. to react with the first added inorganic solid, and precipitate the clay from the effluent. This chemical reaction is instantaneous, and the effluent is clean within minutes.

The heavy oil/bitumen from point 1 above is centrifuged for a maximum of 30 minutes at a minimum of 5000 rpm (Photo 4). There are no rags and there is complete separation producing clean oil.

The diluent used herein is toluene, but any other diluent may be used e.g. condensate, d-limonene etc.

After centrifugation, the BSW (bottoms, sediment and water) is added to the effluent. The instant precipitate which results traps clay from the effluent causing the water to be crystal clear, but yellow in colour (Photo 5).

The yellow colour is thought to be the inorganic soluble salts which are present in the tar sand solids or may be as a result of weathering/deterioration during storage (FIG. 5).

Photos 6 (a and b) shows the difference in colours of the oil/hydrocarbon wet tar sand and the water wet tar sand.

To ensure that the water is fit to be released into the environment or reused, an acid e.g. hydrochloric acid is added to bring the pH to 6-8.

As stated, the process of clay precipitation is instant and clear effluent can be obtained by two methods:

1. Using the extracted clay and sand as a filtration bed for the water with the precipitated clay and sand.
2. Centrifugation of the treated effluent for a maximum of 15 minutes at a maximum of 5000 rpm.

Any carry over of oil in the effluent, is recovered in the centrifugation step. At this stage there is no free oil left in the solids, with any oil present being closely adhered to the solids (see process efficiency). The solids can therefore be placed back into the environment.

Photos 7 (a and b) show the solids from the oil/hydrocarbon wet and water wet tar sands.

With filtration, if there is any oil carry-over, it will not be easily recovered even though the oil is trapped in the filtration bed. The solids from the filtration cannot be replaced into the environment as there would be residual diluent which produces an odor. Furthermore, with filtration there is inefficient recovery of the treated effluent.

Of the two methods stated herein for obtaining clean effluent, centrifugation is the preferred option.

The process described herein is cost effective, both in terms of the cost to produce a barrel of oil and the cost to treat the associated effluent.

BRIEF DESCRIPTION OF THE DRAWING

FIG. 1 is a block diagram of the process for the removal of heavy oil/bitumen from water wet and/or oil/hydrocarbon wet tar sand and the cleaning up of the resulting effluent.

DETAILED DESCRIPTION OF THE INVENTION

Into a mechanical mixer is placed the following:

30-65% by weight of oil wet or water wet tar sand 30-65% by weight of an inorganic liquid e.g. water at ambient temperature or reused inorganic liquid at ambient temperature 0.05-5% of a silicate or metasilicate Mixing time is up to a maximum of 3 hours. However, for very weathered/deteriorated samples a mixing time up to a maximum of 6 hours can be used.

This process could be batch or continuous.

Weight of the second inorganic chemical e.g. chlorides or nitrates or sulphates is 0.05-5% by weight. The amount of 37% hydrochloric added being 0.05-1.5% by weight.

6) Results—Oil

Tar Sand samples used were:

Weathered (deteriorated) water wet tar sand from Trinidad and Tobago—TT. A large sample size of this tar sand was exposed to the elements e.g. rain for >24 hrs at an average temperature of 30° C. A 5 gal sample was then taken from the under surface of the load and stored in the lab. Use was made of the sample as needed—the sample was not refrigerated.

Oil wet tar sand obtained from the USA-OW. This sample was also not refrigerated, and was used within a year of receipt. This sample was taken from different locations which were then mixed together for homogeneity.

Water wet tar sand obtained from Canada-WW. This sample was also not refrigerated, and was used within 2-3 months of receipt. This sample was taken from different locations which were then mixed together for homogeneity.

Due to the extreme weathering of the TT sample, this was used as a reference only, with the results below pertaining only to WW and OW.

6A Moisture Content

A 30 g sample each of OW and WW was removed from the larger samples and air dried in the lab.

Each sample was brought to constant weight, and the % moisture obtained.

| Tar Sand Type | % Moisture |
|---|---|
| OW | 1.96 |
| WW | 7.48 |

6B Maximum Theoretical Yield on Air Dried Tar Sand Samples

Once constant weight was arrived at, each tar sand sample was ashed using ASTMD 2415.

This procedure yields the maximum theoretical yield as ashing removes not only the bitumen/heavy oil, but also any water of hydration, volatile matter from clay and other minerals and other extraneous organic matter (Attwooll, A. W. & Broome, D. C., 1962, *Trinidad Lake Asphalt*; Third Edition (Private Circulation), London: The Baynard Press.)

This would give rise to a decrease in the % inorganics (clay/sand) and an increase in the % organics. This invention therefore uses all the organic material which is removed after ashing as the bitumen/heavy oil portion—hence the maximum yield.

| Tar Sand Type | % Ash (inorganics) results are for duplicate experiments, with the average of the 2 experiments in brackets | % Organics (subtraction) |
|---|---|---|
| OW (air dried) | 90.00, 89.01 (89.55) | 10.45 |
| WW (air dried) | 89.36, 89.40 (89.38) | 10.62 |

6C Actual % Yield

| Tar Sand Type | Density (g/cc)** | API Gravity** | Actual Wt. of heavy oil/bitumen (g)** |
|---|---|---|---|
| OW | 0.997 | 10.32 | 129.93 |
| WW | 1.013 | 8.02 | 141.96 |

**Results obtained by independent testing.

| Tar sand Type | Wt. Of Tar sand Used (g) | Maximum Theoretical Wt. of Bitumen/Heavy Oil Expected (g) | Yield of the Process (%) |
|---|---|---|---|
| OW | 1534 | 160.30 | 81.05 |
| WW | 1652 | 175.44 | 80.91 |

The FIGURES for both the OW and the WW samples are the minimum yields which would be obtained when use is made of the process stated herein.

It is a well-known fact that water wet samples weather (deteriorate) faster than the oil/hydrocarbon wet tar sand and refrigeration is required after mining to halt this deterioration. Once weathered it becomes more difficult to extract the heavy oil/bitumen from the tar sand and yields are reduced. The samples used in this patent were not refrigerated so as to test the process described herein on the most challenging samples. Samples that had been refrigerated, would have been less weathered and would produce higher yields than described in the table above.

Additionally, the moisture content was not considered in the actual yields. This was due to the fact that when each tar sand type is being processed, the samples of tar sand used will each have different moisture levels.

6D Efficiency of Process

After extraction of the heavy oil/bitumen from the tar sand (oil wet and water wet), treating of the effluent and centrifugation, the solids (clay/sand) from the tar sand, were then air dried. A representative portion of each inorganic (clay/sand) sample from the tar sand was ashed as per ASTM D2415. This would remove any residual organics left in the tar sand and would give an indication of the residual organics left in the tar sand after extraction of the heavy oil/bitumen giving an efficiency of the process.

| Type of tar sand (air dried) | % Ash (inorganics) results are for duplicate experiments, with the average of the 2 experiments in brackets | % Organics (by subtraction) |
|---|---|---|
| OW | 95.99, 95.79 (95.89) | 4.11 |
| WW | 94.81, 93.63 (94.22) | 5.78 |

The efficiency of the process is 94-95% for water wet tar sand and 95-96% for oil (hydrocarbon) wet tar sand.

The COD results are believed to be caused by any oxidisable soluble salts present in the tar sand solids.

6F Volume of Water Recovered

The solids present in the tar sand (oil wet and water wet) have an affinity for water and even after centrifugation, each residual solid type still contained some water.

At this point, the clay/sand present in each tar sand type is a wet solid and can be placed back into the environment.

In an attempt to recover even more clean water, each residual solid was compressed (for e.g. by hand) and re centrifuged.

The results are as stated below:

| Tar Sand Type | % Recovery (centrifugation) results are for duplicate experiments, with the average of the 2 experiments in brackets | % Recovery (hand compression)* results are for duplicate experiments, with the average of the 2 experiments in brackets | % Total recovery results are for duplicate experiments, with the average of the 2 experiments in brackets |
|---|---|---|---|
| WW | 67.12, 70.11 (68.62) | 6.90, 6.67 (6.79) | 74.02, 76.78 (75.4) |
| OW | 73.56, 75.11 (74.34) | 2.75, 2.13 (2.44) | 76.31, 77.23 (76.77) |

*One would expect mechanical compression to lead to even further recovery than that obtained by hand compression Results—Effluent As stated, the function of the second inorganic chemical which is used in the process is two-fold, to remove the clay/sand/water which is still in the oil and just as importantly to produce an instant reaction which precipitates the clay.

There is immediate separation of the dirty effluent, and crystal clear water (though with a yellow tinge) can be observed rising to the top.

The mixture is centrifuged at a maximum of 5000 rpm for a maximum of 15 minutes.

To ensure the quality of the water the BOD (Biological Oxygen Demand) and the COD (Chemical Oxygen Demand) values were obtained for both the WW and OW tar sands.

6E BOD & COD-OW

| Parameter Name | Method Used | Units | Results** | EMA Permissible Level for Inland Surface Water |
|---|---|---|---|---|
| BOD5 | SMEWW 5210B | $mg \cdot L^{-1}$ | 16.2 | 30 |
| Chemical Oxygen Demand (COD) | SMEWW 5220 D | $mg \cdot L^{-1}$ | 106 | 250 |

**Results obtained by independent testing pH of the tested effluent - 8.14 (Please note - the OW effluent was not diluted)

BOD & COD-WW

| Parameter Name | Method Used | Units | Results** | EMA Permissible Level for Inland Surface Water |
|---|---|---|---|---|
| BOD5 | SMEWW 5210B | $mg \cdot L^{-1}$ | 10.8 | 30 |
| Chemical Oxygen Demand (COD) | SMEWW 5220 D | $mg \cdot L^{-1}$ | 312 | 250 |

**Results obtained by independent testing pH of the tested effluent - 7.32 (Please note - the WW effluent was not diluted)

The BOD results of the effluent from each tar sand type clearly show that there is little or no carry over of oil/diluent in the effluent.

6G 70% of the water used can be recovered with 15 minutes from the WW tar sands. The rest can be recovered within the time frame that is required for additional compression to occur.

The BOD and COD of the resulting water are stated herein.

73-75% of the water used can be recovered within 15 minutes from the OW tar sands. The rest can be recovered with the time frame that is required for additional compression to occur.

The BOD and COD of the resulting water are stated herein.

6H As the water loss with each tar sand type is significant; an attempt was made to ascertain where the loss could have occurred.

After centrifugation and squeezing etc., the clay/sand from each tar sand type was air dried to constant weight in the lab.

| Tar Sand Type | Weight Before (g) | Weight After (g) | % Moisture |
|---|---|---|---|
| OW | 207.12 | 173.62 | 16.17 |
| WW | 210.61 | 178.95 | 15.03 |

The loss could therefore be simply water absorbed/absorbed by the clay and/or both determinate and indeterminate errors.

6I To produce one barrel of heavy oil using the process described herein requires 4.68 barrels of water of which 75% is recovered and becomes reused effluent which meets the BOD and COD specifications stated above, and 25% is added (make-up) water.

The invention claimed is:

1. A process for removal of heavy oil/bitumen from oil/hydrocarbon wet and/or water wet tar sand, comprising:

mixing tar sand, an inorganic liquid and a first inorganic solid for a period of time sufficient for the inorganic liquid and inorganic solid to interact and strip the heavy oil/bitumen from the tar sand, wherein the tar sand, inorganic liquid and first inorganic solid are mixed in a mixing vessel at ambient temperature, and further comprising passing the mixture through one or more meshes which trap the heavy oil/bitumen having some clay and sand attached thereto, and recirculating into the mixing vessel effluent passing through the meshes until the mixing vessel is clear of sand and clay.

2. The process of claim 1, wherein the tar sand, inorganic liquid and first inorganic solid are mixed for a period of time up to 3 hours.

3. The process of claim 1 wherein the water or effluent passing through the meshes is a muddy mixture of clay with dense sand settled at the bottom thereof.

4. The process of claim 3 further comprising washing the heavy oil/bitumen with water or treated effluent to remove more of the clay and sand attached thereto.

5. The process of claim 4 wherein the heavy oil/bitumen is washed at a temperature not higher than 58° C.

6. The process of claim 4 further comprising adding to the washed heavy oil/bitumen a diluent and a second inorganic solid to strip all solids and liquids from the heavy oil/bitumen and to react with the first inorganic solid to precipitate any solids/clay from the effluent so that it is clear.

7. The process of claim 6 wherein the second inorganic solid is a chloride, sulphate or nitrate.

8. The process of claim 6 whereby the resulting solids/clay are environmentally safe and can be released into the environment.

9. The process of claim 7 wherein the diluent is an organic liquid e.g. toluene, a condensate or d-limonene.

10. The process of claim 6 whereby the minimum oil recovery is 80%.

11. The process of claim 6 further comprising centrifuging the heavy oil/bitumen for up to 30 minutes at a minimum of 5,000 rpm to produce clean heavy oil/bitumen.

12. The process of claim 6 further comprising centrifuging treated effluent for up to 15 minutes at a maximum of 5,000 rpm to recover treated effluent and any oil in the effluent.

13. The process of claim 6 wherein an acid is added to the treated effluent to bring the pH to 6-8 so that the effluent meets environmental standards and can be released into the environment or reused.

14. The process of claim 13 wherein the acid is hydrochloric acid.

15. The process of claim 6 where greater than 75% of the treated effluent can be recovered.

16. The process of claim 1 wherein the inorganic liquid is water or a treated effluent and the first inorganic solid is a silicate or metasilicate, or a combination thereof.

* * * * *